US009346637B2

(12) United States Patent
Uchino et al.

(10) Patent No.: US 9,346,637 B2
(45) Date of Patent: May 24, 2016

(54) FEED APPARATUS AND IMAGE RECORDING APPARATUS

(71) Applicant: BROTHER KOGYO KABUSHIKI KAISHA, Nagoya-shi, Aichi-ken (JP)

(72) Inventors: Yuta Uchino, Nagoya (JP); Wataru Sugiyama, Nishio (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/663,197

(22) Filed: Mar. 19, 2015

(65) Prior Publication Data

US 2015/0274454 A1 Oct. 1, 2015

(30) Foreign Application Priority Data

Mar. 31, 2014 (JP) ..... 2014-072215

(51) Int. Cl.

| | |
|---|---|
| ***B65H 7/02*** | (2006.01) |
| ***B65H 3/06*** | (2006.01) |
| ***B65H 5/06*** | (2006.01) |
| ***B65H 7/18*** | (2006.01) |
| ***B65H 3/34*** | (2006.01) |

(52) U.S. Cl.

CPC ..... *B65H 3/0684* (2013.01); *B65H 3/0661* (2013.01); *B65H 3/34* (2013.01); *B65H 5/068* (2013.01); *B65H 7/02* (2013.01); *B65H 7/18* (2013.01); *B65H 2402/46* (2013.01); *B65H 2405/324* (2013.01); *B65H 2407/20* (2013.01); *B65H 2407/21* (2013.01); *B65H 2553/61* (2013.01); *B65H 2601/322* (2013.01)

(58) Field of Classification Search

CPC ..... B65H 3/0661; B65H 3/0684; B65H 3/56
See application file for complete search history.

(56) References Cited

U.S. PATENT DOCUMENTS

| | | | | |
|---|---|---|---|---|
| 3,640,524 | A | 2/1972 | Fredrickson | |
| 5,209,465 | A | 5/1993 | Sayama et al. | |
| 6,659,449 | B2 * | 12/2003 | Kim | B65H 1/266 271/117 |
| 6,918,583 | B2 * | 7/2005 | Asada | B65H 3/0661 271/110 |
| 7,607,655 | B2 | 10/2009 | Oomori et al. | |
| 7,857,303 | B2 | 12/2010 | Oomori et al. | |
| 7,950,650 | B2 * | 5/2011 | Koyanagi | B65H 1/00 271/161 |

(Continued)

FOREIGN PATENT DOCUMENTS

JP 2001-106346 A 4/2001

OTHER PUBLICATIONS

Related U.S. Appl. No. 14/501,585, filed Sep. 30, 2014.

(Continued)

*Primary Examiner* — Jeremy R Severson
(74) *Attorney, Agent, or Firm* — Merchant & Gould P.C.

(57) ABSTRACT

There is provided a feed apparatus including: a support unit supporting a sheet; a feed roller; a first arm; a recess portion; a second arm; a biasing member; an operation lever; and an engagement portion. The engagement portion is configured to be separated from the second arm at the first position in a case that the feed roller abuts against the support surface. The engagement portion is configured to be engaged with the second arm in a case that the first arm swings in a direction in which the feed roller is separated from the support surface. The second arm is configured to swing from the first position to the second position in conjunction with swing of the first arm in a direction in which the feed roller is further away from the support surface.

7 Claims, 9 Drawing Sheets

(56) References Cited

U.S. PATENT DOCUMENTS

| | | | | |
|---|---|---|---|---|
| 8,254,826 | B2 | 8/2012 | Uchino et al. | |
| 8,366,096 | B2 | 2/2013 | Mizude et al. | |
| 8,556,258 | B2 | 10/2013 | Mizubata et al. | |
| 2007/0001375 | A1* | 1/2007 | Zhu | B65H 3/0661 271/117 |
| 2010/0001453 | A1 | 1/2010 | Mizude et al. | |
| 2013/0140765 | A1* | 6/2013 | Mizubata | B65H 3/66 271/254 |
| 2015/0158684 | A1* | 6/2015 | Uchino | B65H 3/0684 271/110 |
| 2015/0183598 | A1* | 7/2015 | Suganuma | B65H 3/0684 358/498 |

OTHER PUBLICATIONS

Office Action issued in related U.S. Appl. No. 14/501,585, dated Mar. 3, 2015.

Office Action issued in related U.S. Appl. No. 14/501,585, Nov. 17, 2015.

Office Action issued in related U.S. Appl. No. 14/501,585, Mar. 11, 2016.

* cited by examiner

FEED APPARATUS AND IMAGE RECORDING APPARATUS

CROSS REFERENCE TO RELATED APPLICATION

The present application claims priority from Japanese Patent Application No. 2014-072215, filed on Mar. 31, 2014, the disclosure of which is incorporated herein by reference in its entirety.

BACKGROUND

1. Field of the Invention

The present invention relates to a feed apparatus configured to feed a sheet supported by a support unit and an image recording apparatus including the feed apparatus.

2. Description of the Related Art

There is conventionally known a feed apparatus configured such that a support unit in a state of being inclined supports a plurality of sheets stacked thereon and each of the sheets is fed obliquely downward along the inclination of the support unit. In this feed apparatus, the sheets are pushed to the support unit by the own weight of a feed roller.

SUMMARY

However, in the feed apparatus as described above, the sheets supported by the support unit in the state of being inclined are more likely to move along the inclination of the support unit. The reasons thereof are considered as follows. First, it is caused by own weight of the sheets supported by the support unit in the state of being inclined and/or the frictional force between a sheet arranged on the uppermost side and the sheet abutting against the uppermost sheet caused when the uppermost sheet is fed by the rotation of the feed roller. The reason(s) is(are) more likely to cause the sheets to move along the inclination of the support unit. As a result, there is fear that the overlapped feed (or multi feeding) of sheets are more likely to occur. Another reason is considered as follows. That is, in the feed apparatus as described above, there is some distance between a separation claw which is a separation member and the feed roller. Thus, although the sheets are pushed toward the support unit at a position at which the sheets abut against the feed roller by the own weight of the feed roller, no sheet is pushed toward the support unit by the feed roller in an area between the separation claw and the feed roller. Therefore, in the area between the separation claw and the feed roller, a gap may be sometimes formed between stacked sheets during the consecutive feed of sheets. In such a case, the abutting angles between the sheets and the separation claw vary, which causes the variation of the conveyance force required to let the sheet ride over the separation claw. Consequently, the overlapped feed (or multi feeding) of sheets could occur.

The present teaching has been made to solve the foregoing problems, an object of which is to provide a mechanism capable of reducing the possibility of occurrence of the overlapped feed (or multi feeding) of sheets and capable of causing the sheet to be inserted into a support unit easily.

According to a first aspect of the present teaching, there is provided a feed apparatus configured to feed a sheet, including:

a support unit having a support surface configured to support the sheet;

a feed roller configured to feed the sheet supported by the support surface in a feed direction;

a first arm having one end configured to rotatably support the feed roller and the other end configured to be swingable to function as a swing shaft;

a recess portion provided on the support surface;

a second arm having one end positioned on an upstream side of the other end in the feed direction; having a distance between the one end and the support surface which is greater than a distance between the other end and the support surface; and configured to be swingable with a side of the one end as a swing shaft, between a first position at which the other end is in the recess portion and a second position at which the other end is outside the recess portion;

a biasing member configured to bias the second arm toward the first position;

an operation lever provided in the first arm; and an engagement portion provided in the first arm and configured to abut against the second arm from a side of the support surface so as to be engaged therewith, wherein the engagement portion is configured to be separated from the second arm at the first position in a case that the feed roller abuts against the support surface;

the engagement portion is configured to be engaged with the second arm in a case that the first arm swings in a direction in which the feed roller is separated from the support surface; and the second arm is configured to swing from the first position to the second position in conjunction with swing of the first arm in a direction in which the feed roller is further away from the support surface.

In a case that sheets enter the support unit, the second arm is retracted toward the second position and the feed roller is retracted in the direction away from the support surface. The sheets supported by the support surface of the support unit are pushed to the support surface by the second arm biased toward the first position. In a case that the feed roller abuts against the support surface or the sheet supported by the support surface, the engagement portion is separated from the second arm at the first position. Thus, the first arm and the second arm are swingable independently from each other.

In a case that a sheet with low stiffness such as plain paper enters the support unit, the operation lever is operated to swing the first arm, so that the feed roller can be separated from the support surface. Swinging the first arm in the direction in which the feed roller is separated from the support surface engages the engagement portion with the second arm, and the second arm moves in conjunction with the swing of the first arm in the direction in which the feed roller is further away from the support surface. Accordingly, the feed roller can be separated from the support surface by the operation of the operation lever and the second arm can swing from the first position to the second position. Thus, the sheet entering the support unit never contacts with the feed roller and the second arm. In a case that a user stops the operation of the operation lever, the first arm swings to cause the feed roller to abut against the sheet supported by the support surface. Further, the second arm biased toward the first position abuts against the sheet supported by the support surface.

According to a second aspect of the present teaching, there is provided an image recording apparatus, including: the feed apparatus as defined in the first aspect; and a recording unit configured to record an image on a sheet fed by the feed roller.

According to the present teaching, it is possible to reduce the possibility of occurrence of the overlapped feed (or multi feed) of sheets. Further, the sheet can be inserted into the support unit easily.

DESCRIPTION OF THE EMBODIMENTS

Figure 1:
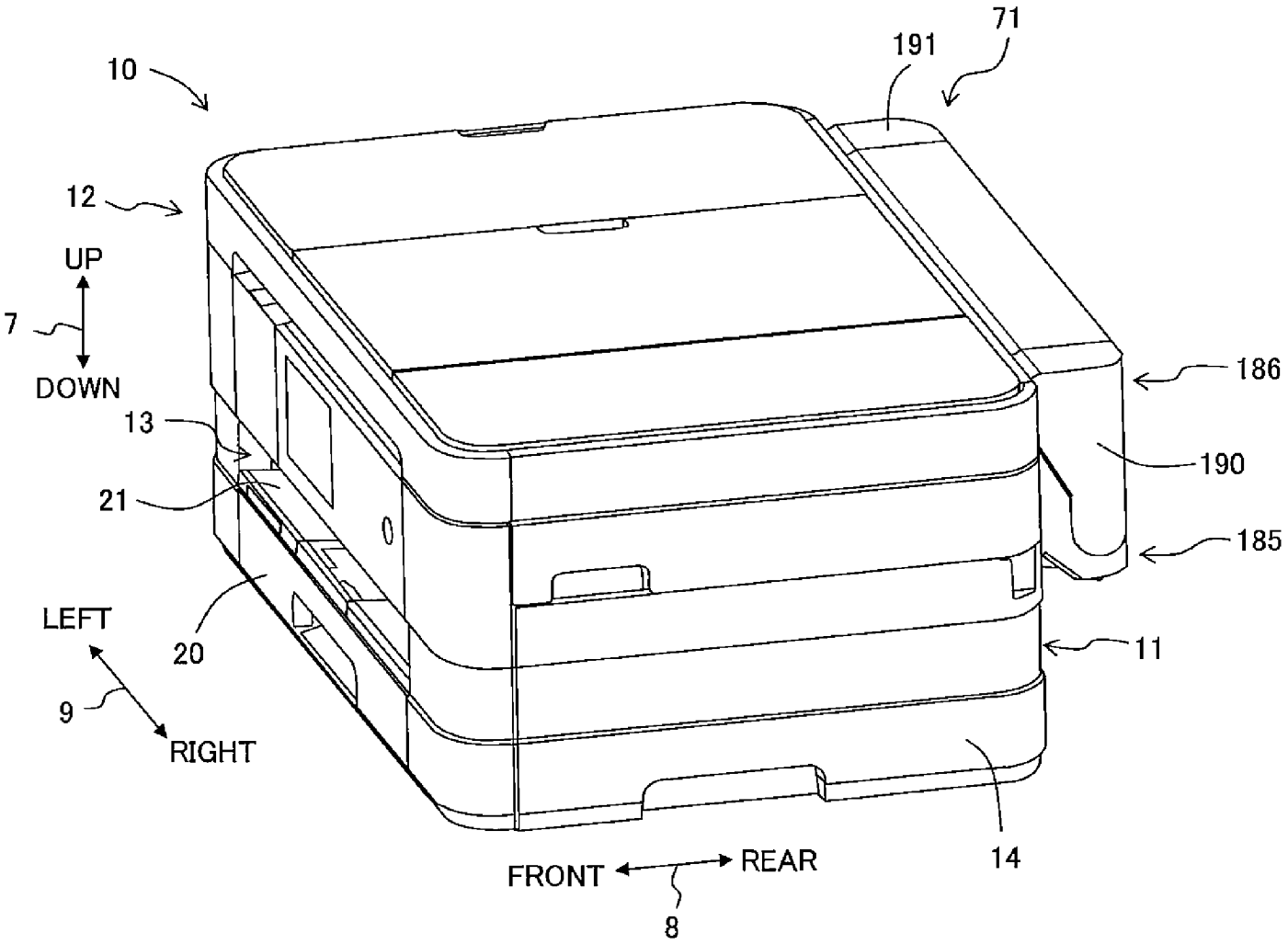
FIG. 1 is a perspective external view of a multifunction peripheral 10 in which a movable unit 186 is in an upstanding state.

An explanation will be made about a multifunction peripheral 10 according to an embodiment of the present teaching. It is needless to say that the embodiment to be explained below is merely an example of the present teaching, and it is possible to appropriately change the embodiment of the present teaching without departing from the gist and scope of the present teaching. Further, in the following explanation, an up-down direction 7 of the multifunction peripheral 10 is defined on the basis of such a state that the multifunction peripheral 10 is placed to be usable (the state depicted in FIG. 1); a front-rear direction 8 of the multifunction peripheral 10 is defined as an opening 13 is provided on the near side (the front side); and a left-right direction 9 of the multifunction peripheral 10 is defined as the multifunction peripheral 10 is viewed from the near side (the front side).

<Entire Structure of Multifunction Peripheral 10>

As depicted in FIG. 1, the multifunction peripheral 10 is formed to have an approximately cuboid form, and the multifunction peripheral 10 includes a printer unit 11 of an ink-jet recording system to record an image on a sheet such as a recording sheet S. The multifunction peripheral 10 includes various functions such as a facsimile function and a print function.

The printer unit 11 has a casing or housing body 14 with the opening 13 formed in its front surface. Further, a feed tray 20 and a discharge tray 21 are insertable to and removable from the casing 14 via the opening 13 in the front-rear direction 8. The feed tray 20 can load or accommodate recording sheets S of various sizes. The bottom surface of the casing 14 abuts against a placement surface on which the multifunction peripheral 10 is placed.

Figure 2:
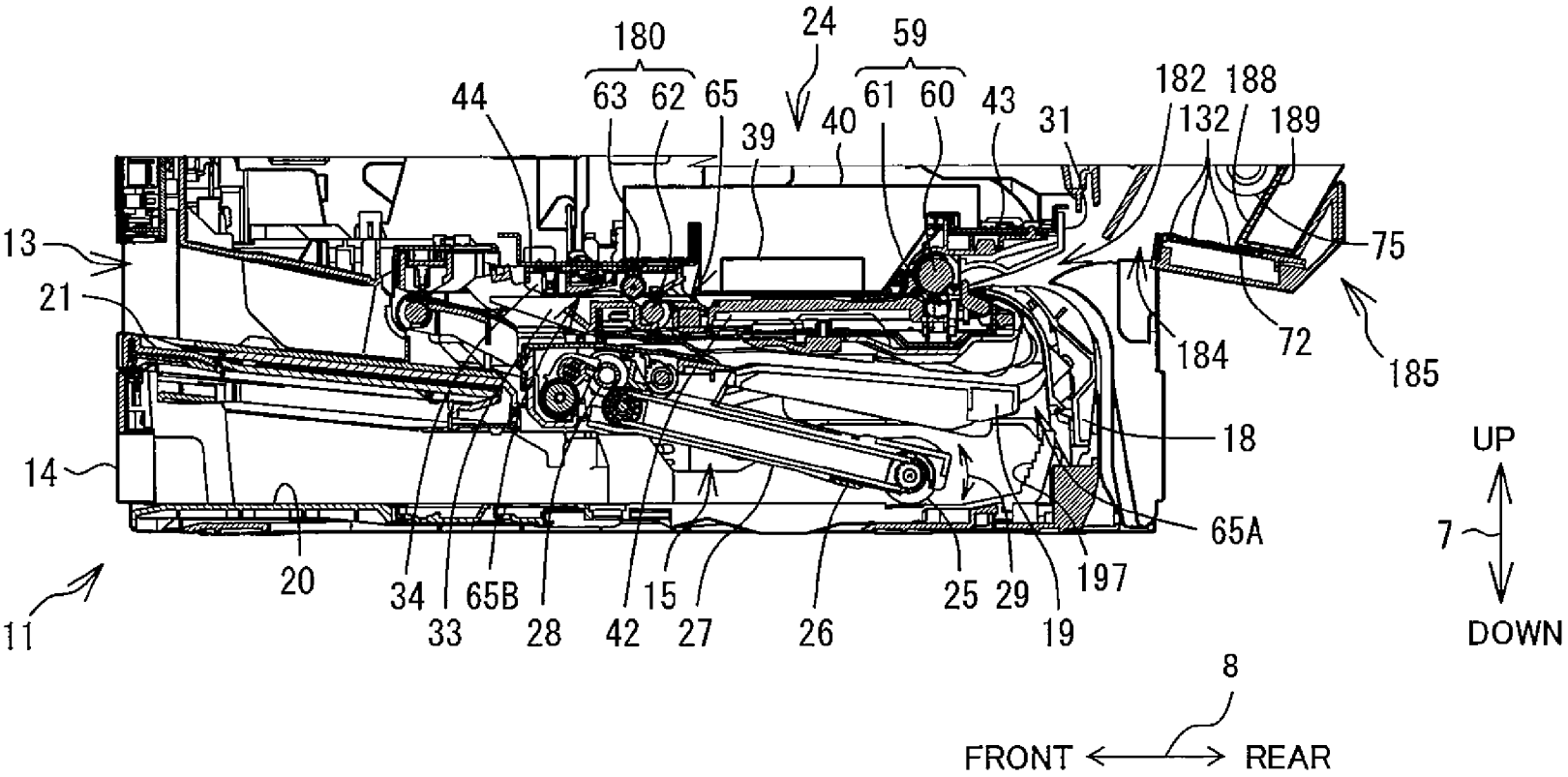
FIG. 2 is a vertical cross-sectional view of an internal structure of a printer unit 11.

As depicted in FIG. 2, the printer unit 11 includes a feed unit 15 which feeds the recording sheet S from the feed tray 20, a recording unit 24 which records an image on the recording sheet S, a first conveyance roller pair 59, a second conveyance roller pair 180, and the like.

As depicted in FIG. 1, a scanner unit 12 is provided above the printer unit 11. The scanner unit 12 is a flatbed scanner. Since the structure of the flatbed scanner is publicly known, any detailed explanation of which will be omitted herein.

<Printer Unit 11>

The structure of the printer unit 11 will be explained in detail below. The printer unit 11 is an exemplary image recording apparatus of the present teaching.

<Feed Tray 20>

As for the feed tray 20 depicted in FIGS. 1 and 2, the lengths in the front-rear direction 8 and the left-right direction 9 are longer than the length in the up-down direction 7, and the feed tray 20 has a box-shaped form in which the upper surface is open. The discharge tray 21 is provided on the upper surface of the feed tray 20 at the front side. The feed tray 20 can accommodate recording sheets S of various sizes such as the A4 size based on the Japanese Industrial Standards and the L size used for the photograph recording, by supporting the recording sheets S with a support surface. The feed tray 20 is detachably installed in the internal space communicating with the opening 13 of the casing 14. The feed tray 20 is movable back and forth in the front-rear direction 8 with respect to the casing 14 via the opening 13.

<Feed Unit 15>

As depicted in FIG. 2, the feed unit 15 includes a feed roller 25, a feed arm 26, and a driving transmission mechanism 27. The feed unit 15 is provided above the feed tray 20 and below the recording unit 24. The feed roller 25 is rotatably supported by the forward end of the feed arm 26. The feed arm 26 swings in the directions of the arrow 29 with a swing shaft 28 provided at the proximal end as the center of swing. Accordingly, the feed roller 25 can abut against the support surface of the feed tray 20 and the feed roller 25 can be separated therefrom. Therefore, in a case that the feed tray 20 loading the recording sheets S is installed in the casing 14, the feed roller 25 can abut against the recording sheets S placed on the feed tray 20.

The driving force of a motor (not depicted) is transmitted to the feed roller 25 by the aid of the driving transmission mechanism 27. The driving transmission mechanism 27 transmits the rotation transmitted to the swing shaft 28 to the shaft of the feed roller 25 by an endless belt. The feed roller 25 is rotated in such a state that the feed roller 25 is allowed to abut against the recording sheet S disposed on the uppermost side of the recording sheets S supported by the support surface of the feed tray 20, and thus the uppermost recording sheet S is fed to a conveyance path 65. In a case that the recording sheet S is fed to the conveyance path 65, the forward end of the recording sheet S abuts against a separation member 197 provided on the back side of the feed tray 20 in the front-rear direction 8. As a result, only the recording sheet S disposed on the uppermost side is separated from the recording sheets S disposed on a lower side and then conveyed. On the other hand, the recording sheets S disposed on the lower side of the uppermost recording sheet S are retained in the feed tray 20 without being dragged by the recording sheet S disposed on the uppermost side.

<Conveyance Path 65>

As depicted in FIG. 2, the conveyance path 65, which is provided in the internal space of the casing 14, extends while being curved to make U-turn upward from the back side of the feed tray 20. Further, the conveyance path 65 is bent toward the front side from the hack side of the printer unit 11, and when extends substantially straight to the front side of the printer unit 11 to arrive at the discharge tray 21. The conveyance path 65 is roughly classified into a curved passage 65A which makes U-turn and a straight passage 65B which is straight.

The curved passage 65A is defined by an outer guide member 18, an inner guide member 19, and a guide member 31. The outer guide member 18 and the inner guide member 19, the inner guide member 19 and the guide member 31, and the guide member 31 and the outer guide member 18 are respectively opposed to each other while being separated by the space through which the recording sheet S can pass. The straight passage 65B is defined by the recording unit 24, a platen 42, a guide member 34, and a guide member 33. The recording unit 24 and the platen 42 are opposed to each other while being separated by the space through which the recording sheet S can pass, and the guide member 34 and the guide member 33 are opposed to each other while being separated by the space through which the recording sheet S can pass.

The recording sheet S, which is fed to the conveyance path 65 by the feed roller 25 of the feed tray 20, is conveyed from a lower side to an upper side of the curved passage 65A. In this situation, a conveyance direction of the recording sheet S is inverted from a backward direction to a forward direction. Then, the recording sheet S is conveyed from the rear side to the front side in the front-rear direction 8 through the straight passage 65B without inverting the conveyance direction.

The guide member 31 is arranged above the inner guide member 19 on the immediately upstream side (the back side) of the first conveyance roller pair 59. The outer guide member 18 and the guide member 31 also define a bypass route 182 described later on.

<First Conveyance Roller Pair 59 and Second Conveyance Roller Pair 180>

As depicted in FIG. 2, in the conveyance path 65, the first conveyance roller pair 59 is provided on the upstream side of the recording unit 24 in the conveyance direction (forward direction in the front-rear direction 8). The first conveyance roller pair 59 has a first conveyance roller 60 and a pinch roller 61. In the conveyance path 65, the second conveyance roller pair 180 is provided on the downstream side of the recording unit 24 in the conveyance direction. The second conveyance roller pair 180 has a second conveyance roller 62 and a spur roller 63. The rotation of a motor (not depicted) is transmitted to the first and second conveyance rollers 60, 62, and thus the first and second conveyance rollers 60, 62 are allowed to rotate. The first conveyance roller pair 59 and the second conveyance roller pair 180 convey the recording sheet S by rotating the first conveyance roller 60 and the second conveyance roller 62 in a state that the recording sheet S is interposed between the respective rollers constructing the first conveyance roller pair 59 and the second conveyance roller pair 180.

<Recording Unit 24>

As depicted in FIG. 2, the recording unit 24 is provided between the first conveyance roller pair 59 and the second conveyance roller pair 180. The recording unit 24 includes a carriage 40 and a recording head 39. The carriage 40 is supported to be reciprocatively movable in the left-right direction 9 by guide rails 43, 44 provided on the back side and the front side of the platen 42.

The recording head 39 is carried on the carriage 40. A plurality of unillustrated nozzles are formed on the lower surface of the recording head 39. Inks are supplied from ink cartridges (not depicted) to the recording head 39. The recording head 39 selectively discharges the inks as minute ink droplets from the plurality of nozzles. In a case that the carriage 40 is moved in the left-right direction 9, the ink droplets are discharged from the nozzles to the recording sheet S supported by the platen 42. The discharged ink droplets adhere to the recording sheet S on the platen 42, and thus an image is recorded on the recording sheet S.

<Bypass Route 182>

As depicted in FIG. 2, an opening 184 is provided on the back surface of the casing 14. The bypass route 182, which extends from the opening 184 to the first conveyance roller pair 59, is formed in the casing 14. The bypass route 182 extends from the upper backward to the lower frontward in the casing 14. The bypass route 182 is defined by the guide member 31 and the outer guide member 18. The conveyance path 65 is disposed below the bypass route 182.

The recording sheets S placed on a bypass tray 71 (see FIGS. 1 and 3) described later on are each guided obliquely downward via the bypass route 182. Each of the recording sheets S is guided via the straight passage 65B of the conveyance route 65 and conveyed by the first conveyance roller pair 59. Then, the image recording is performed on the recording sheet S by the recording unit 24 and the recording sheet S is discharged on the discharge tray 21.

<Feed Apparatus 70>

Figure 3:
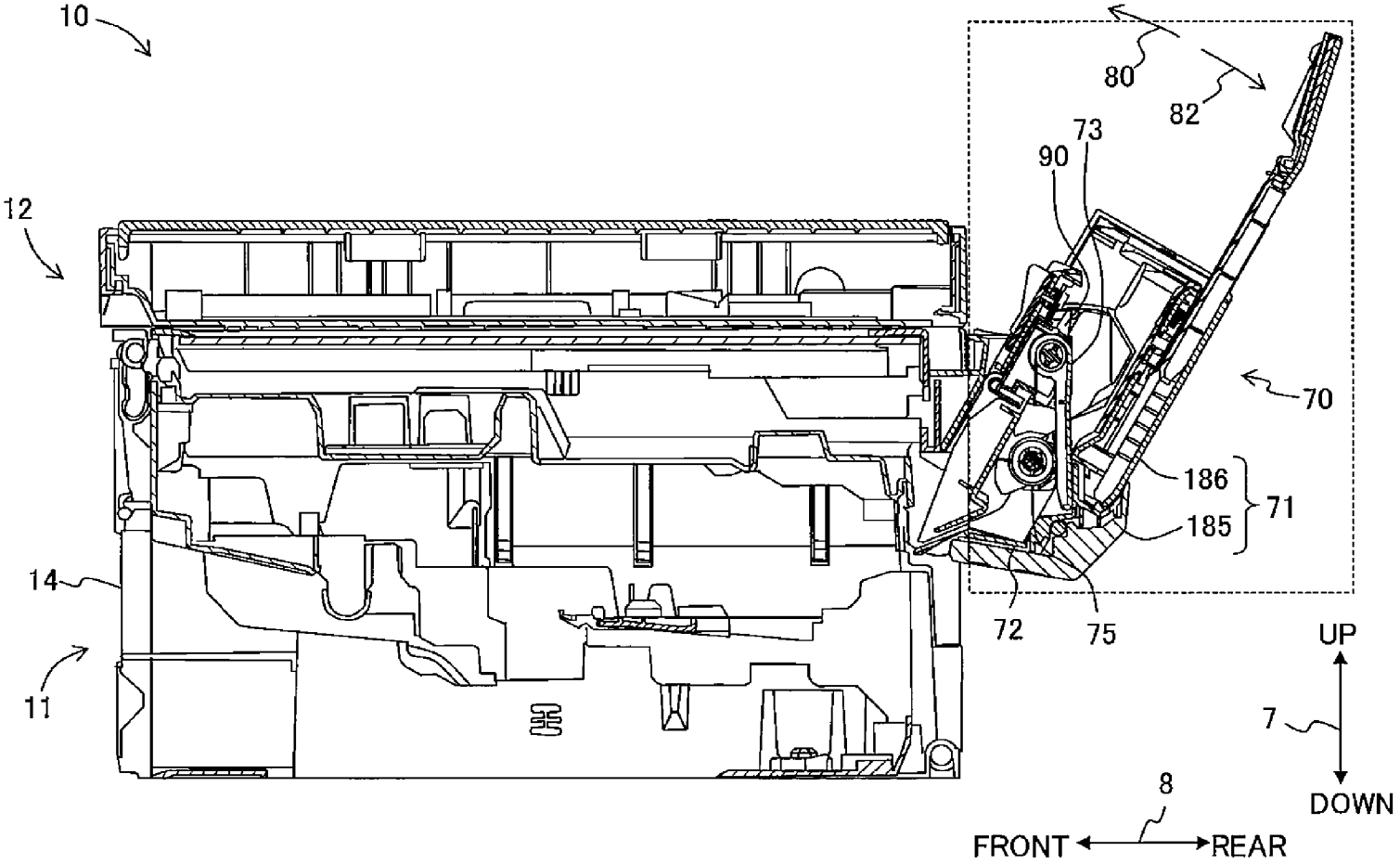
FIG. 3 is a vertical cross-sectional view of the multifunction peripheral 10 in which a holding arm 73 is positioned at a first position.
Figure 4:
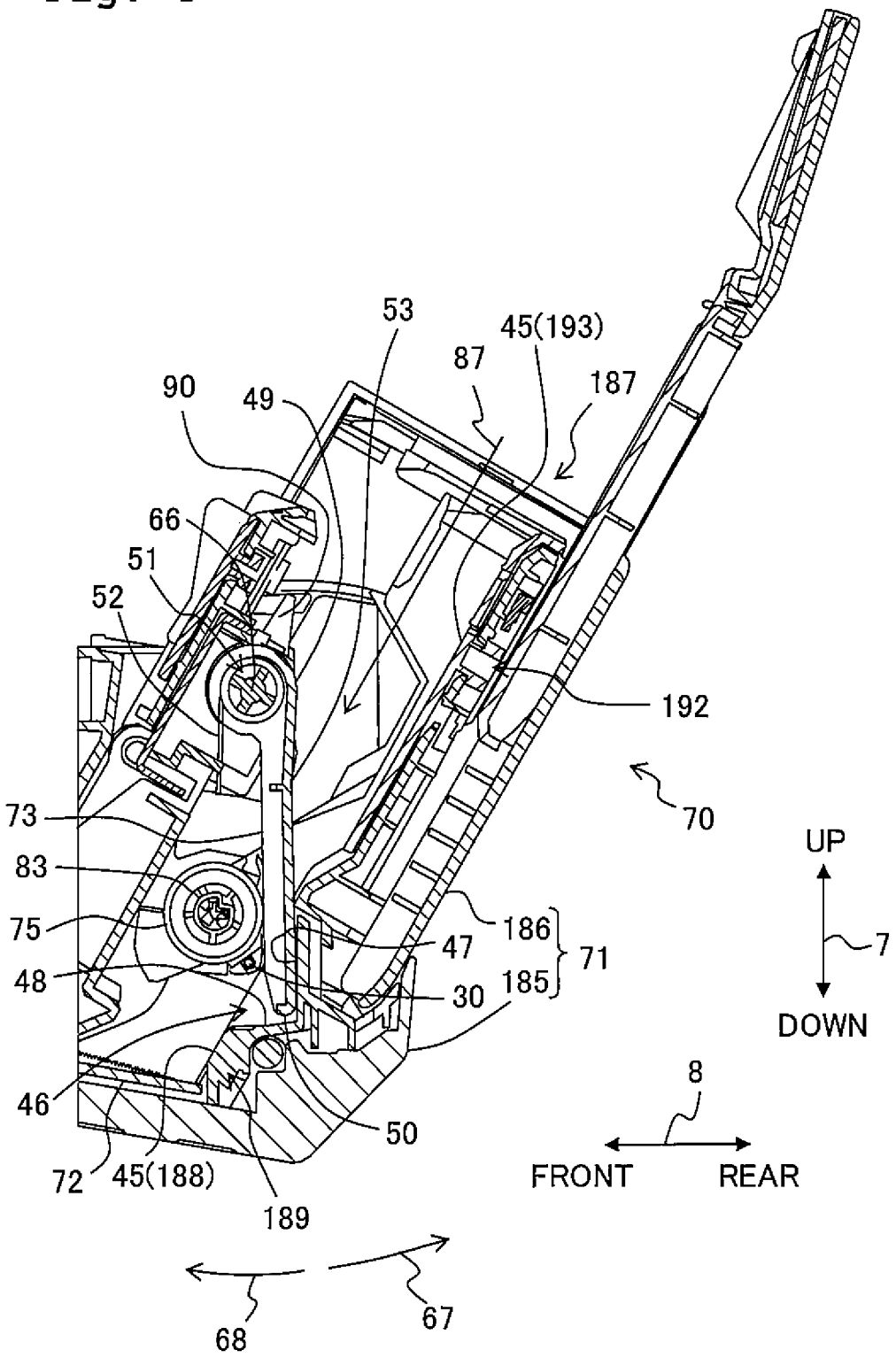
FIG. 4 is an enlarged view of a part enclosed in the rectangular frame depicted by dotted lines in FIG. 3.

As depicted in FIGS. 3 and 4, the printer unit 11 includes a feed apparatus 70. The feed apparatus 70 includes the bypass tray 71 (an exemplary support unit of the present teaching), a feed roller 75 (an exemplary feed roller of the present teaching), a feed arm 76 (an exemplary first arm of the present teaching), a holding arm 73 (an exemplary second arm of the present teaching), a torsion spring 52 (an exemplary basing member of the present teaching), a sheet sensor 54 (an exemplary detecting unit of the present teaching), and a separation piece 72.

<Bypass Tray 71>

As depicted in FIGS. 1, 3 and 4, the bypass tray 71 is provided on the back surface side of the multifunction peripheral 10. The bypass tray 71 can accommodate the recording sheets S independently from the feed tray 20.

An opening 187 is formed in the bypass tray 71. The recording sheets S can be accommodated in the bypass tray 71 via the opening 187. In the bypass tray 71, a passage is formed via the opening 187 to arrive at the bypass mute 182 (see FIG. 2).

A fixed unit 185, which extends downward to cover the opening 184 (see FIG. 2) therewith, is formed on the back surface side of the casing 14. The fixed unit 185 constitutes a part of the bypass tray 71 on the downstream side in the conveyance direction. A movable unit 186 is provided on the upper side of the fixed unit 185 so as to be swingable with respect to the fixed unit 185. The bypass tray 71 is constructed by the fixed unit 185 and the movable unit 186.

A support member 189 including a support surface 188 is provided in the fixed unit 185. The support surface 188 extends obliquely downward to the bypass route 182 (see FIG. 2).

The separation piece 72 is provided below the support member 189 of the fixed unit 185. The separation piece 72 is positioned at a height which is substantially the same as that of the opening 184 in the up-down direction 7. The upper surface of the separation piece 72 is a surface against which the forward ends of the recording sheets S supported by the bypass tray 71 abut. On the upper surface of the separation piece 72, a plurality of teeth 132 (see FIG. 2) are aligned in the front-rear direction 8 to project upward. The forward ends of recording sheets S supported by the bypass tray 71 are disentangled or unraveled by the teeth 132.

A driving transmission mechanism (not depicted), which is composed of a plurality of pinion gears, is provided on the right side of the fixed unit 185 in the left-right direction 9. The driving force is transmitted to the driving transmission mechanism from the motor (not depicted) provided at the inside of the casing 14 of the printer unit 11. A swing shaft 66 extends in the left-right direction 9, and one end thereof is meshed or engaged with the pinion gears constituting the driving transmission mechanism. The other end of the swing shaft 66 extends to the center of the fixed unit 185 in the left-right direction 9.

The swing shaft 66 swingably supports the feed arm 76. That is, the feed arm 76 is swingable around the swing shaft 66. The feed roller 75 is rotatably supported by the feed arm 76 on the side of a swing forward end (the end which is not supported by the swing shaft 66). The feed arm 76 extends downward from the swing shaft 66 toward the support surface. 188 of the support member 189. The feed arm 76 is arranged at the center of the fixed unit 185 in the left-right direction 9. The structure of the feed arm 76 will be explained in detail below.

The feed roller 75 is connected to the swing shaft 66 by a gear row 36 (see FIG. 7) which is formed by engaging three gears 37A, 37B, and 37C with one another. The rotation of the swing shaft 66 is transmitted to the feed roller 75 via the gear row 36 to rotate the feed roller 75. The feed roller 75 is rotated in a state of being allowed to abut against the recording sheet S disposed on the uppermost side of the recording sheets S supported by the support surface 188, and thus the uppermost recording sheet S is fed via the bypass route 182 in a feed direction 87 (a direction to the discharge tray 21 from the bypass tray 71, see FIG. 4). The recording sheets S, which are disposed on the lower side of the uppermost recording sheet S, are disentangled or unraveled by the separation piece 72 and they are retained in the bypass tray 71 without being dragged by the recording sheet S disposed on the uppermost side. The structure of the feed roller 75 will be explained in detail below.

The movable unit 186 is provided on the upper side of the fixed unit 185 to be swingable with respect, to the fixed unit 185. The movable unit 186 is swingable between the upstanding state in which the movable unit 186 upstands in the up-down direction (see FIG. 1) and the inclined or laid-down state in which the movable unit 186 is inclined with respect to the up-down direction 7 (see FIG. 3).

The upstanding state is a state for reducing the space for the movable unit 186 on the back surface side of the casing 14. The bypass tray 71 is not used when the movable unit 186 is in the upstanding state. The inclined state is the state in which the movable unit 186 is inclined obliquely upwardly toward the outside of the casing 14, and thus the inclined support surfaces 188, 193 are substantially provided as one flat surface, and the inclined state is the state in which the bypass tray 71 can be used.

A support member 192 is provided in the movable unit 186. In the inclined state of the movable unit 186, the support surface 193 provided on the upper surface of the support member 192 and the support surface 188 form substantially the same flat surface. Thus, a surface 45 (an exemplary support surface of the present teaching), which is formed by the support surface 188 of the support member 189 and the support surface 193 of the support member 192, supports the recording sheet S in the bypass tray 71. Here, "substantially one flat surface (the same flat surface)" means a flat surface on which the supported recording sheet S is neither bent nor flexed even when there is a small difference in height between two surfaces constituting the flat surface; in other words, it means a flat surface on which the recording sheet S is supported so that separation performance is stably obtained by the separation piece 72.

Figure 6:
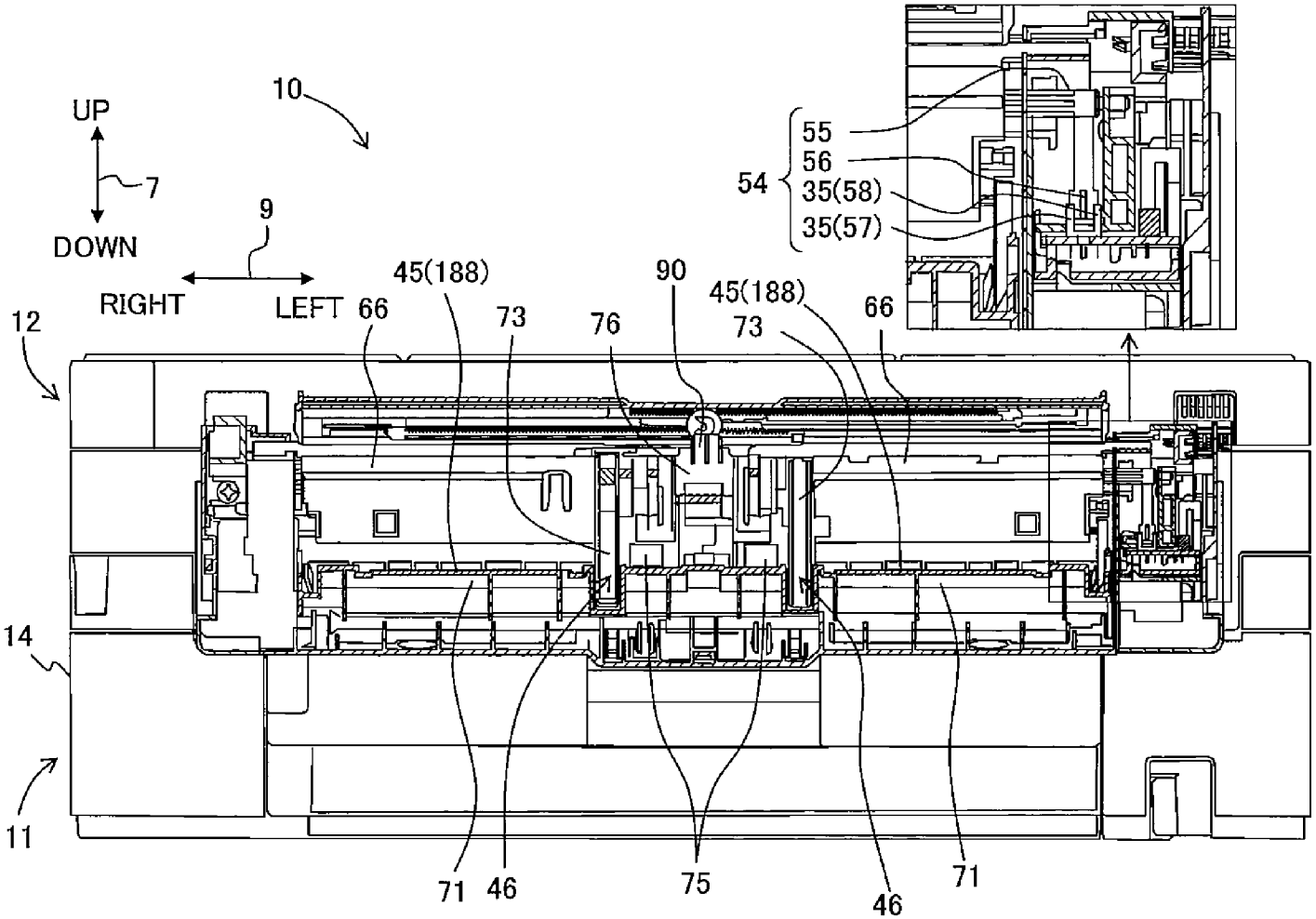
FIG. 6 is a back view of the multifunction peripheral 10.

As depicted in FIGS. 4 and 6, two recesses 46 are provided in the surface 45 (support surface 188 of the support member 189) of the bypass tray 71. The other end 50 of the holding arm 73 described later on is inserted into the recess 16. The two recesses 46 are arranged at the same position in the feed direction 87. Further, the two recesses 46 are respectively arranged on the right side and left side of the feed rollers 75 in the left-right direction 9. That is, the two recesses 46 are provided as a pair to interpose the feed rollers 75 therebetween.

<Feed Roller 75 and Feed Arm 76>

As depicted in FIG. 4, the feed roller 75 is arranged on the frontward side of the bypass tray 71. The feed roller 75 can abut against the support surface 188 of the support member 189. A rotational shaft 83 of the feed roller 75 extends in the left-right direction 9. Although two feed rollers 75 are provided with a spacing distance intervening therebetween in the left-right direction 9 as depicted in FIGS. 6 and 7, the number of feed rollers 75 is not limited to two.

The feed arm 76 extends in a state of being inclined to the support surface 188 at a position above the support surface 188. The feed arm 76 extends from its one end to be away from the surface 45 of the bypass tray 71 toward the upstream side in the feed direction 87. The feed roller 75 is supported via the rotational shaft 83 at one end of the feed arm 76 to be rotatable around a rotation center 75X (see FIG. 7). The swing shaft 66 is inserted through a hole 92 (see FIG. 7) provided at an upstream-side end of the feed arm 76 in the feed direction 87 (i.e., the hole 92 is provided at the other end of the feed arm 76). Accordingly, the feed arm 76 swings in the directions of the arrows 67, 68 (see FIG. 4) with the swing shaft 66 provided at the other end as the center of swing. As a result, the feed roller 75 can abut against the support surface 188 of the support member 189 or the recording sheet S supported by the support surface 188 and the feed roller 75 can be separated therefrom.

The feed arm 76 is connected to the swing shaft 66 by an unillustrated torsion spring. Accordingly, the feed arm 76 is biased by the torsion spring in the direction of the arrow 67. The structure for biasing the feed arm 76 in the direction of the arrow 67 is not limited to a structure using the torsion spring. For example, a coil spring may be arranged on the frontward side of the feed arm 76 such that one end of the coil spring is connected to the feed arm 76 and the other end of the coil spring is connected to a frame of the printer unit 11. The feed arm 76 may be biased by the coil spring in the direction of the arrow 67.

Figure 5:
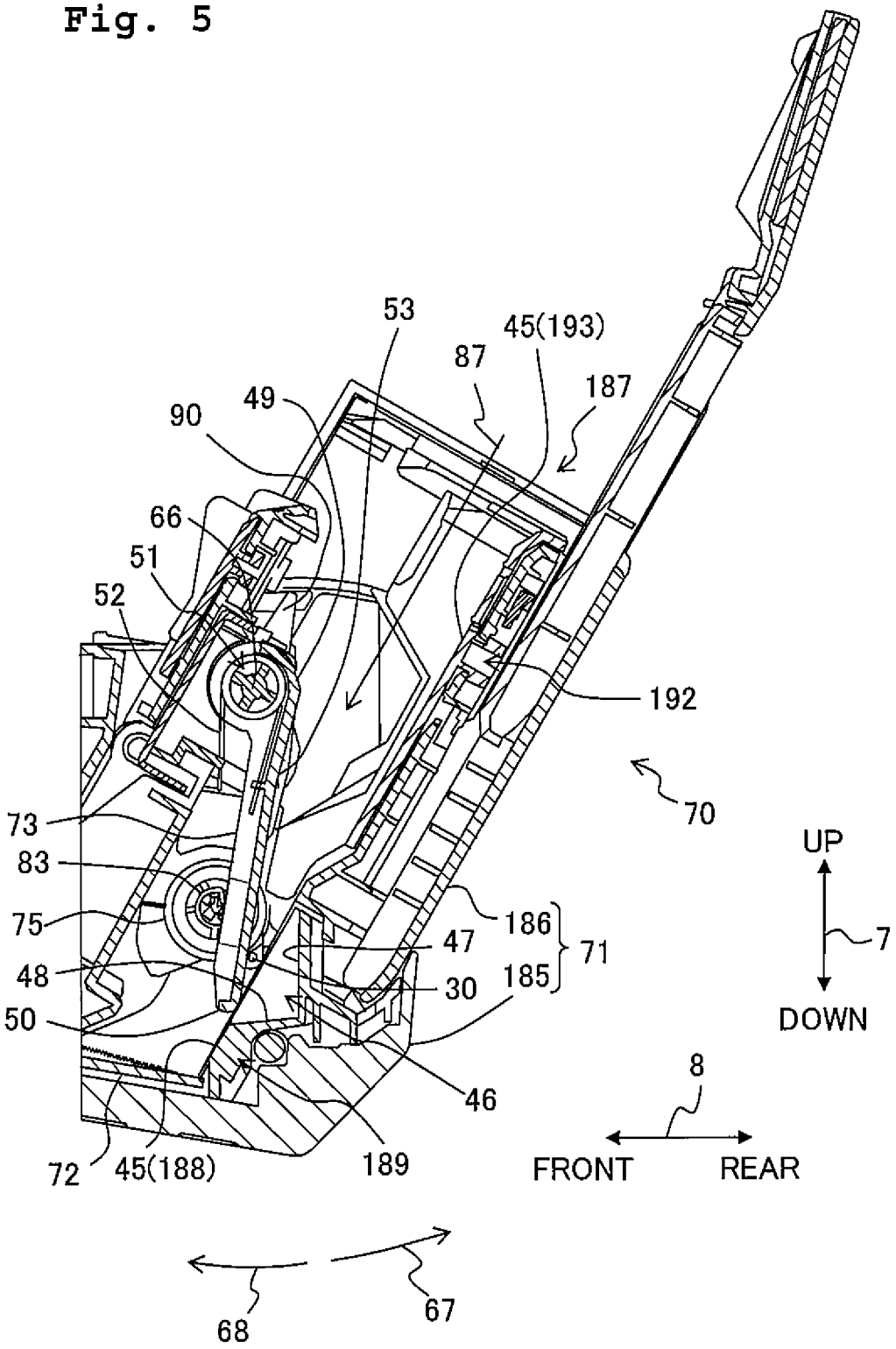
FIG. 5 is an enlarged view of the part enclosed in the rectangular frame depicted by dotted lines in FIG. 3 depicting a state in which the holding arm 73 is positioned at a second position.
Figure 7:
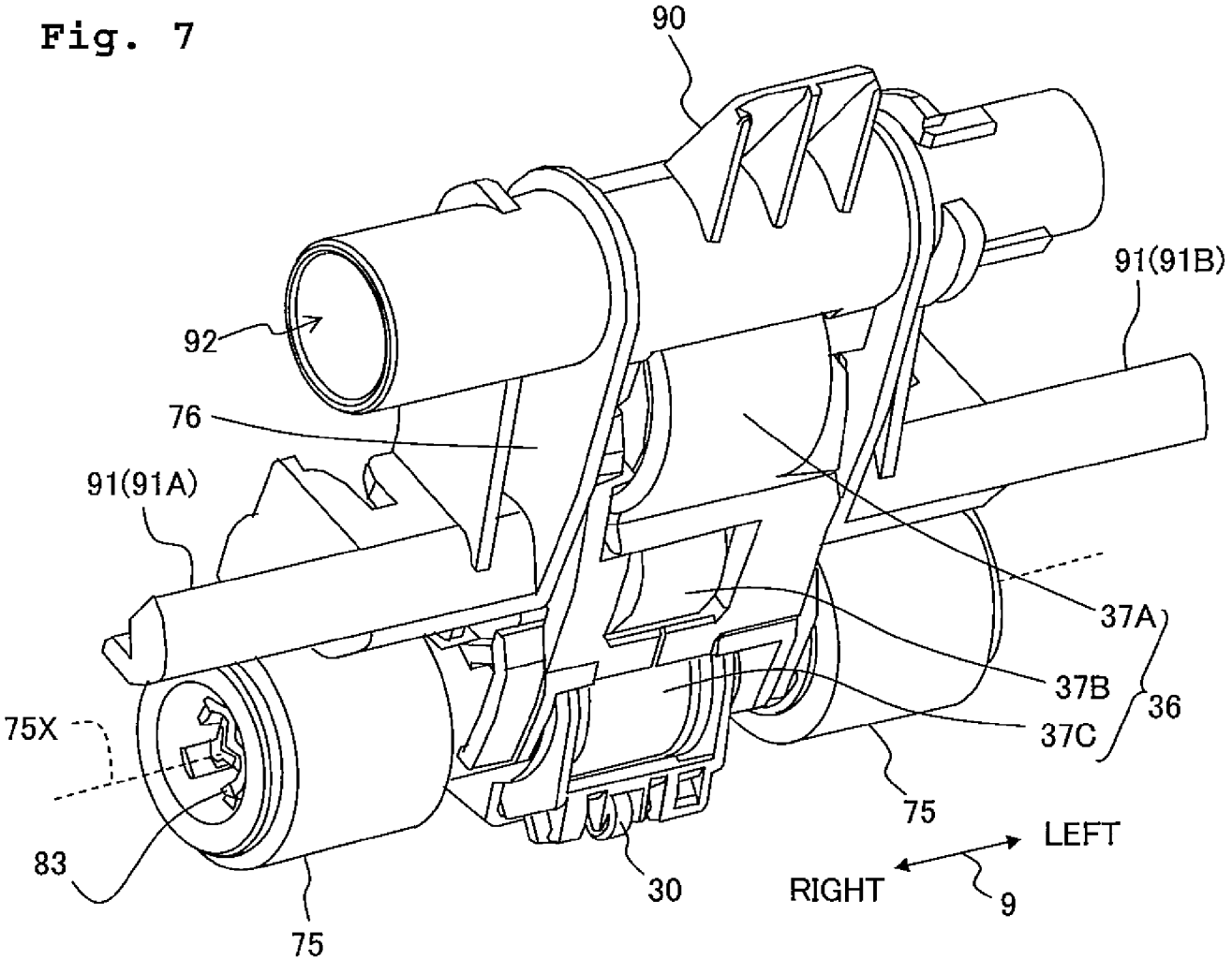
FIG. 7 is a perspective view of a peripheral part of a feed arm 76.
Figure 9A:
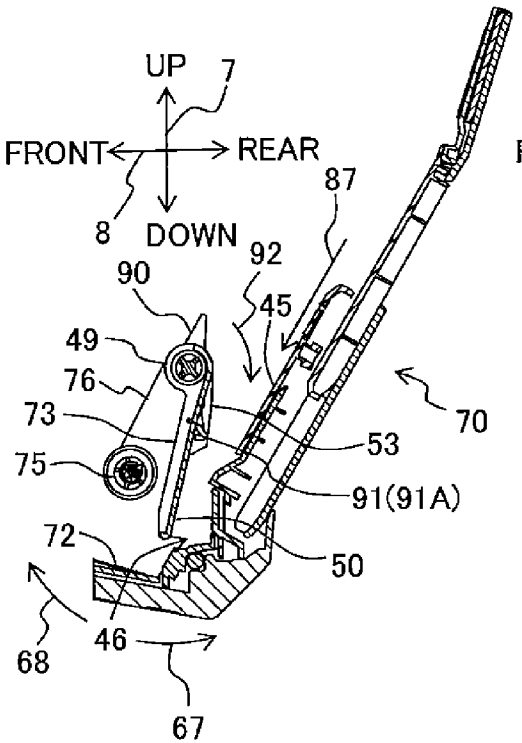
FIG. 9A-9C are other vertical cross-sectional views of the peripheral part of the feed apparatus 70.
Figure 9B:
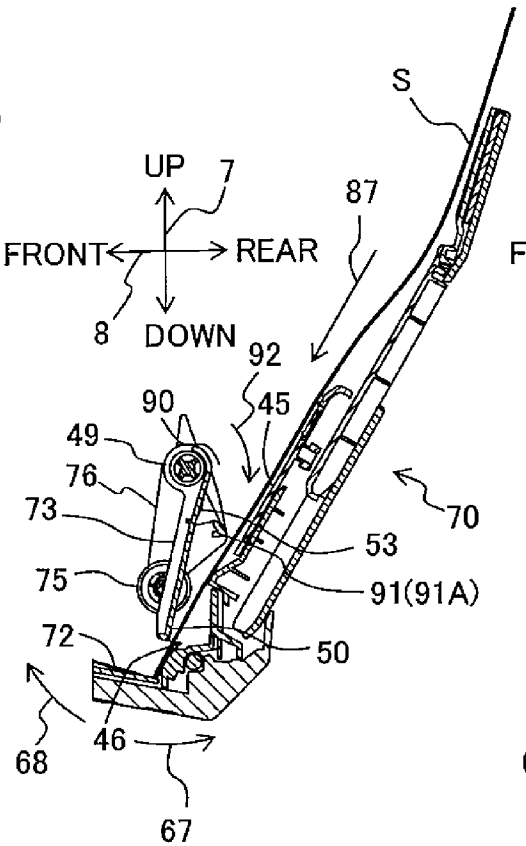

In this embodiment, the feed arm 76 is swingable by a contact-separating mechanism 30 (see FIGS. 4, 5, and 7). The structure of the contact-separating mechanism 30 may be any publicly known structure on condition that the feed arm 76 is swingable in the directions of the arrows 67, 68. In a case that the recording sheet S supported by the bypass tray 71 is fed, the contact-separating mechanism 30 causes the feed arm 76 to swing in the direction of the arrow 67 so that the feed roller 75 abuts against the recording sheet S supported by the surface 45. On the other hand, in a case that the recording sheet S supported by the bypass tray 71 is not fed, the contact-separating mechanism 30 causes the feed arm 76 to swing in the direction of the arrow 68 so that the feed roller 75 is separated from the support surface 188 (surface 45) of the support member 189. This creates a gap between the recording sheet S and the feed roller 75 even when the recording sheet S is supported by the surface 45 as depicted in FIG. 9B.

The feed arm 76 is swingable manually instead of using the contact-separating mechanism 30. This manual swing will be described later.

<Holding Arm 73>

As depicted in FIG. 4, similar to the feed arm 76, the holding arm 73 extends at a position above the support surface 188. The holding arm 73 extends from one end 49 to be closer to the support surface 188 of the support member 189 toward the downstream side in the feed direction 87. That is, the one end 49 of the holding arm 73 is positioned at the upstream side of the other end 50 in the feed direction 87, and the distance between the one end 49 and the surface 45 is greater than the distance between the other end 50 and the surface 45. The swing shaft 66 is inserted through a hole 51 provided on the side of the upstream-side end of the holding arm 73 in the feed direction 87 (i.e., the hole 51 is provided on the side of the one end 49). Accordingly, the holding arm 73 swings in the directions of the arrows 67, 68 with the swing shaft 66 as the center of swing, in the some manner as the feed arm 76. That is, the holding arm 73 is swingable with the side of the one end 49 as the swing shaft and the side of the other end 50 as the side of the forward end of the swing. As a result, the side of the forward end of the holding arm 73 can abut against the support surface 188 or the recording sheet S supported by the support surface 188 and the side of the forward end of the holding arm 73 can be separated therefrom.

As described above, the swing shaft 66 is inserted through both the feed arm 76 and the holding arm 73. Therefore, the center of the swing shaft of the feed arm 76 is the same as the center of the swing shaft of the holding arm 73. Further, the feed arm 76 and the holding arm 73 are swingable independently from each other.

The other end 50 of the holding arm 73 is curved to be convex toward the downstream side in the feed direction 87 as viewed from the left side or the right side (the far side or the near side in the vertical direction with respect to the paper surface).

The number of holding arms 73 provided is the same as the number of the recesses 46 provided for the support surface 188 of the support member 189. That is, in this embodiment, the holding arm 73 includes a plurality of holding arms 73 provided as a pair. Each of the holding arms 73 is arranged on the right side or the left side of the feed rollers 75. Each of the holding arms 73 corresponds to one of the two recesses 46. As depicted in FIG. 6, the holding arms 73 are disposed to interpose the feed rollers 75 therebetween in the left-right direction 9, which is orthogonal to the feed direction 87 and extends along the support surface 188.

As depicted in FIG. 6, the width of the other end 50 of the holding arm 73 in the left-right direction 9 is narrower than the width of the corresponding recess 46. Accordingly, as depicted in FIG. 4, the other end 50 of the holding arm 73 is capable of entering the recess 46. The position of the holding arm 73 in the state depicted in FIG. 4 corresponds to a first position of the present teaching. On the other hand, as depicted in FIG. 5, the holding arm 73 in the first position swings in the direction of the arrow 68, and thus the other end 50 of the holding arm 73 is retractable from the recess 46. The position of the holding arm 73 in the state depicted in FIG. 5 corresponds to a second position of the present teaching. Accordingly, the holding arm 73 is swingable between the first position and the second position.

As depicted in FIG. 4, in a case that the holding arm 73 is positioned at the first position, a surface 53 (an exemplary guide surface of the present teaching) is positioned on the upstream side of the feed roller 75 in the feed direction 87. The surface 53 is a part which is included in the surface of the holding arm 73 on the upstream side in the feed direction 87 and which does not enter the recess 46.

As depicted in FIG. 5, in a case that the holding arm 73 is positioned at the second position, the other end 50 of the holding arm 73 is positioned on the downstream side of the feed roller 75 in the feed direction 87. More specifically, in the case that the holding arm 73 is positioned at the second position, the other end 50 of the holding arm 73 is positioned on the downstream side of the rotation center 75X of the feed roller 75 abutting against the recording sheet S supported by the support surface 188 in the feed direction 87.

The holding arm 73 is connected to the swing shaft 66 by the torsion spring 52. Accordingly, the holding arm 73 is biased by the torsion spring 52 in the direction of the arrow 67, i.e., toward the first position. The structure for basing the holding arm 73 in the direction of the arrow 67 is not limited to the structure using the torsion spring 52. For example, a coil spring may be arranged on the frontward side of the holding arm 73 such that one end of the coil spring is connected to the holding arm 73 and the other end of the coil spring is connected to the frame of the printer unit 11. The holding arm 73 may be biased in the direction of the arrow 67 by the coil spring.

<Operation Lever 90>

As depicted in FIGS. 3 to 9, the feed arm 76 is provided with an operation lever 90. The operation lever 90 is a projection protruding from an end of the feed arm 76 on the side of the swing shaft 66. The operation lever 90 protrudes toward the opening 187. This configuration allows a user to easily access the operation lever 90 via the opening 187.

<Engagement Portion 91>

As depicted in FIG. 7, the feed arm 76 is provided with an engagement portion 91. In this embodiment, the engagement portion 91 is formed by a protrusion 91A extending rightward from the feed arm 76 and a protrusion 91B extending leftward from the feed arm 76. The protrusion 91A extends in the left-right direction 9 to a position where the protrusion 91A can abut against the surface 53 of the holding arm 73 on the right side and the protrusion 91B extends in the left-right direction 9 to a position where the protrusion 91B can abut against the surface 53 of the holding arm 73 on the left side. The front ends of the protrusions 91A, 91B are positioned between the holding arms 73 and the surface 45.

Figure 8C:
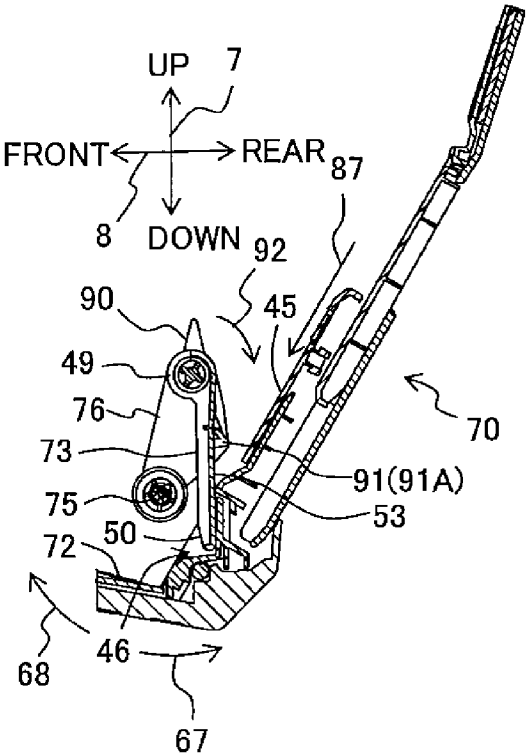
FIG. 8A-8C are vertical cross-sectional views of a peripheral part of a feed apparatus 70.
Figure 8B:
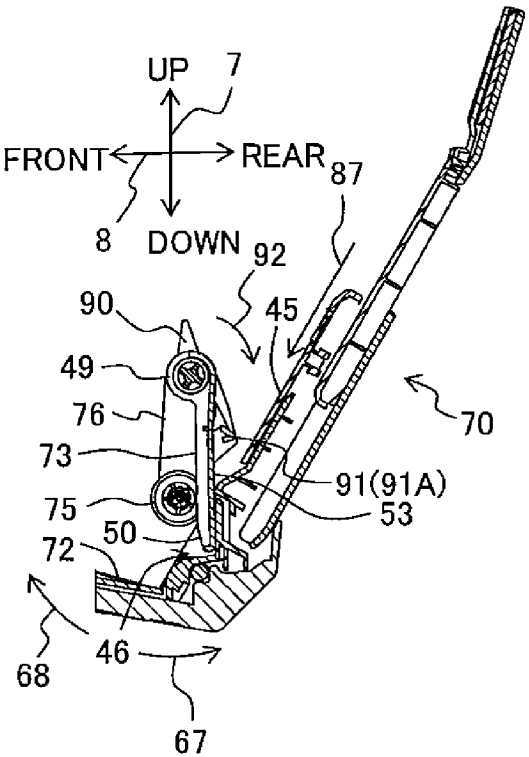

In a state that the feed roller 75 abuts against the surface 45 (see FIG. 8B) and that the feed roller 75 abuts against the recording sheet S supported by the surface 45 (see FIG. 9C), the engagement portion 91 (protrusions 91A, 91B) is separated from the holding arm 73, more specifically, separated from the surface 53 of the holding arm 73. Even when the feed roller 75 in the state depicted in FIG. 8B is rotated by the contact-separating mechanism 30 in the direction of the arrow 68 to be a state that the feed roller 75 is separated from the surface 45 (see FIG. 8A), the engagement portion 91 is separated from the holding arm 73, more specifically, separated from the surface 53 of the holding arm 73. Even when the feed roller 75 in the state depicted in FIG. 9C is rotated by the contact-separating mechanism 30 in the direction of the arrow 68 to be a state that the feed roller 75 is separated from the recording sheet S (see FIG. 9B), the engagement portion 91 is separated from the holding arm 73, more specifically, separated from the surface 53 of the holding arm 73.

Figure 8A:
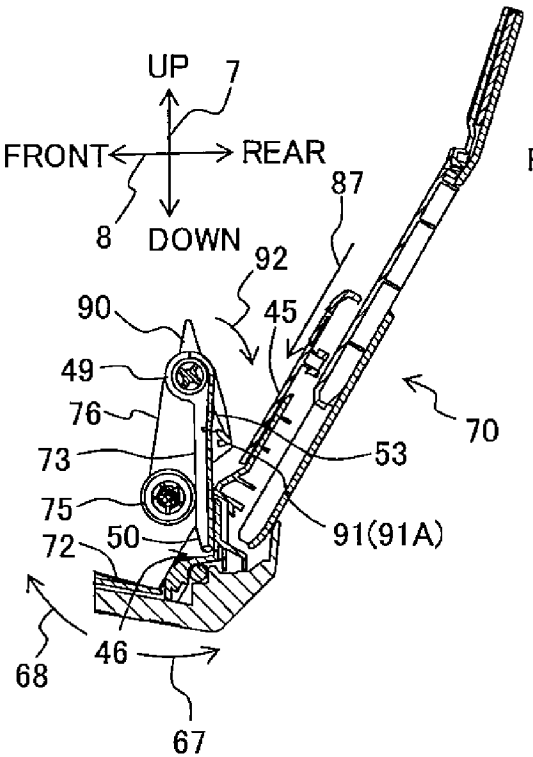
Figure 9C:
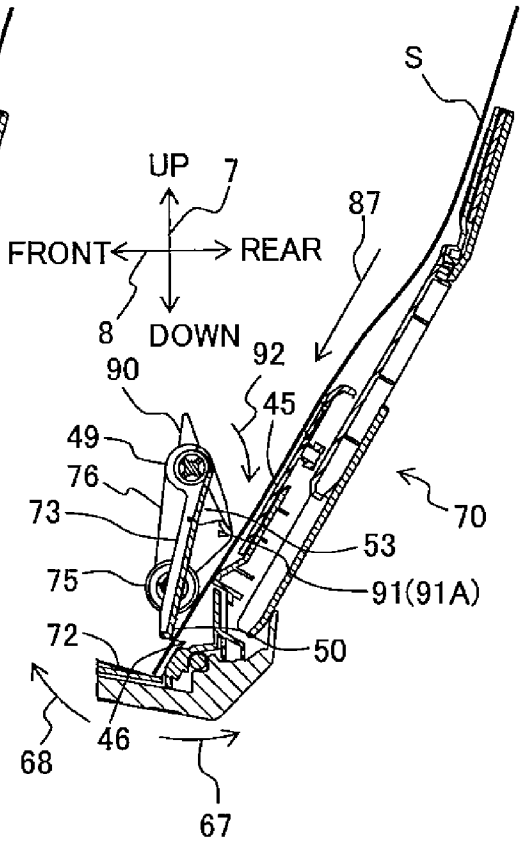

The engagement portion 91 may abut against the surface 53 of the holding arm 73 in the states depicted in FIG. 8A and FIG. 9B.

In a case that the feed arm 76 in the state of each of FIG. 8A, FIG. 8B, FIG. 9B, and FIG. 9C further swings in the direction of the arrow 68, the engagement portion 91 can abut against the surface 53 of the holding arm 73 from the side of the surface 45 and can be engaged therewith (see FIG. 8C).

The engagement portion 91 is not limited to the protrusions 91A, 91B. For example, the engagement portion 91 may be ribs which extend in the left-right direction 9 from the feed arm 76 to a position where the ribs can abut against the surface 53 of the holding arm 73. Unlike the protrusions 91A, 91B, the engagement portion 91 may not be formed as a pair. That is, the engagement portion 91 may be one protrusion or one rib.

<Sheet Sensor 54>

As depicted in FIG. 6, a sheet sensor 54 is provided on the left side of the bypass tray 71. The sheet sensor 54 includes an extending portion 55 extending leftward from the holding arm 73 positioned at the left side, a detector 56 protruding from the left end of the extending portion 55 toward the direction in which the holding arm 73 extends from the extending portion 55, and an optical sensor 35 which has a light-emitting element 57 and a light-receiving element 58 receiving the light emitted from the light-emitting element 57.

The swing of the holding arm 73 positioned on the left side causes the detector 56 to swing integrally with the holding arm 73 positioned on the left side with the extending portion 55 as the center of swing.

In a case that the holding arm 73 is positioned at the first position (FIG. 4), i.e., in a case that the other end 50 of the holding arm 73 enter the recess 46, the projecting forward end of the detector 56 enters between the light-emitting element 57 and the light-receiving element 58 of the optical sensor 35; in other words, the projecting forward end of the detector 56 enters an optical path extending from the light-emitting element 57 to the light-receiving element 58. This blocks the light passing through the optical path. In this situation, a low level signal is output from the optical sensor 35 to a controller (not depicted) controlling the operation of the multifunction peripheral 10. On the other hand, in a case that the holding arm 73 is positioned at the second position (FIG. 5) i.e., in a case that the other end 50 of the holding arm 73 is retracted from the recess 46, the projecting forward end of the detector 56 is retracted from the optical path. This allows the light to pass through the optical path. In this situation, a high level signal is output from the optical sensor 35 to the controller. As described above, the sheet sensor 54 detects whether or not the detector 56 is positioned in the optical path to let the controller detect the position of the holding arm 73 (i.e., whether the holding arm 73 is positioned at, the first position or the second position).

The direction in which the detector 56 protrudes may be a direction different from the extending direction of the holding arm 73. Further, contrary to the above, the projecting forward end of the detector 56 may enter the optical path in the case that the holding arm 73 is positioned at the second position, and the projecting forward end of the detector 56 may be retracted from the optical path in the case that the holding arm 73 is positioned at the first position.

The sheet sensor 54 may be provided on the right side of the holding arm 73 positioned on the right side. In this case, the extending portion 55 extends rightward from the holding arm 73 positioned on the right side.

<Operation of Feed Apparatus 70>

In the following, an explanation will be made about the operation of the feed apparatus 70 in a process in which the operation lever 90 is operated to cause the recording sheet S to be supported by the bypass tray 71. An explanation will be made especially in detail for the operations of the holding arm 73 and the feed arm 76 of the feed apparatus 70.

In a case that no recording sheet S is supported by the surface 45 of the bypass tray 71, the feed roller 75 is separated from the surface 45 by the contact-separating mechanism 30 as depicted in FIG. 8A or abuts against the surface 45 as depicted in FIG. 8B. In both of the states, the holding arm 73 is positioned at the first position by being biased by the torsion spring 52. The other end 50 of the holding arm 73 enters the recess 46 in the case that the holding arm 73 is positioned at the first position. Further, in both of the states, the engagement portion 91 (protrusions 91A, 91B) provided in the feed arm 76 is separate from the holding arm 73. More specifically, the engagement portion 91 (protrusions 91A, 91B) is separate from the surface 53 of the holding arm 73.

In the state depicted in FIG. 8A or FIG. 8B, when the user of the multifunction peripheral 10 moves the operation lever 90 in the direction of an arrow 92 while holding or pressing the operation lever 90, the feed arm 76 swings in the direction of the arrow 68 against the biasing force of an unillustrated torsion spring. This swings the engagement portion 91 integrally with the feed arm 76 in the direction of the arrow 68.

As depicted in FIG. 8C, the engagement portion 91 after the swing abuts against the surface 53 of the holding arm 73 from the lower side (from the side of the surface 45). In a case that the user further swings the feed arm 76 in the state depicted in FIG. 8C in the direction of the arrow 68, the holding arm 73 is pushed by the engagement portion 91 in the direction of the arrow 68. This swings the holding arm 73 in the direction of the arrow 68 from the first position to the second position against the biasing force of the torsion spring 52. As a result, the side of the other end 50 of the holding arm 73 is away from the surface 47 of two surfaces 47, 48 (see FIGS. 4 and 5) defining the recess 46. Further swinging the feed arm 76 in the direction of the arrow 68 causes the holding arm 73 to be retracted from the recess 46 as depicted in FIG. 9A. This creates a gap between the holding arm 73 and the surface 45.

In the state depicted in FIG. 9A, in a case that the user inserts the recording sheet S via the opening 187 in the feed direction 87, the forward end of the recording sheet S in an insertion direction abuts against the surface 53 of the holding arm 73 and is guided by the guide 53. This allows the forward end of the recording sheet S in the insertion direction to pass through the feed arm 76 and the holding arm 73 without being interfered with by the feed arm 76 and the holding arm 73, and then the forward end of the recording sheet S in the insertion direction abuts against the separation piece 72.

In a case that the user or the like releases the operation lever 90, the feed arm 76 swings in the direction of the arrow 67 by the biasing force of the unillustrated torsion spring. This makes the engagement portion 91 (protrusions 91A, 91B) separate from the surface 53 of the holding arm 73, and thus the holding arm 73 swings in the direction of the arrow 67 by the biasing force of the torsion spring 52. As a result, as depicted in FIG. 9B, the holding arm 73 abuts against the recording sheet S between the feed roller 75 and the separation piece 72. Meanwhile, since the feed roller 75 is maintained at the position depicted in FIG. 8A by the contact-separating mechanism 30, the feed roller 75 does not abut against the recording sheet S. The feed roller 75 may not be maintained at the position depicted in FIG. 8A by the contact-separating mechanism 30. In this case, as depicted in FIG. 9C, the feed roller 75 abuts against the recording sheet S like the holding arm 73.

In the state depicted in FIG. 9B, in a case that the user operates an operation unit (not depicted) provided in the multifunction peripheral 10 to give an instruction for image recording onto the recording sheet S, the controller controls the contact-separating mechanism 30 to swing the feed arm 76 in the direction of the arrow 67. This makes the feed roller 75 abut against the recording sheet S supported by the surface 45 of the bypass tray 71 as depicted in FIG. 9C. Further, the controller controls the motor to apply the driving force to the feed roller 75 via the driving transmission mechanism. This rotates the feed roller 75 to feed the recording sheet S in the feed direction 87. As a result, the recording sheet S passes the bypass route 182 to enter the straight passage 65B. The recording unit 24 records or forms an image on the recording sheet S entering the straight passage 65B, and the recording sheet S having the image formed thereon is discharged onto the discharge tray 21 by the second conveyance roller pair 180.

Effects of Embodiment

According to this embodiment, in a case that the recording sheets S enter the bypass tray 71, the holding arm 73 is retracted to the side of the second position and the feed roller 75 is also retracted to separate from the surface 45. The recording sheets S supported by the surface 45 of the bypass tray 71 are pushed to the surface 45 by the holding arm 73 which is biased toward the side of the first position. In a case that the feed roller 75 abuts against the surface 45 or the recording sheets S supported by the surface 45, the engagement portion 91 is separated from the holding arm 73 positioned at the first position. This allows the feed arm 76 and the holding arm 73 to swing independently from each other.

In a case that one recording sheet S with low stiffness such as plain paper enters the bypass tray 71, the operation lever 90 is operated to swing the feed arm 76, so that the feed roller 75 can be separated from the surface 45. Swinging the feed arm 76 in the direction in which the feed roller 75 is separated from the surface 45 engages the engagement portion 91 with the holding arm 73, and the holding arm 73 moves in conjunction with the swing of the feed arm 76 in the direction in which the feed roller 75 is further away from the surface 45. Accordingly, the feed roller 75 is separated from the surface 45 by the operation of the operation lever 90 and the holding arm 73 is allowed to swing from the first position to the second position. Thus, one recording sheet S entering the bypass tray 71 never contacts with the feed roller 75 and the holding arm 73. In a case that the user stops the operation of the operation lever 90, the feed arm 76 swings to cause the feed roller 75 to abut against the recording sheet S supported by the surface 45. Further, the holding arm 73 in a state of being biased toward the first position abuts against the recording sheet S supported by the surface 45.

According to this embodiment, in a state that no recording sheet S is supported by the bypass tray 71, the holding arm 73 is positioned at the first position by being biased by the torsion spring 52. Under this situation, in a case that the recording sheets S enter the feed apparatus 70 from the downstream side in the feed direction 87 so that the recording sheets S are supported by the bypass tray 71, the recording sheets S abut against the surface 53 of the holding arm 73 first. In other words, the recording sheets S do not abut against the feed roller 75 first. Here, the feed roller 75 is a molded product made of rubber or elastomer and the feed roller 75 has concavities and convexities formed on the roller surface thereof. Thus, the recording sheets S abutting against such a roller surface are more likely to be bent. Since the recording sheets S do not abut against the feeing roller 75 first in the configuration of this embodiment, the possibility that the recording sheets S entering the feed apparatus 70 are bent can be reduced.

Subsequently, the recording sheets S entering the feed apparatus 70 are guided to the downstream side in the feed direction 87 along the surface 53 of the holding arm 73. In this situation, the holding arm 73 is pushed by the recording sheets S, which causes the holding arm 73 to swing from the first position to the second position against the biasing force of the torsion spring 52. Accordingly, the recording sheets S can be guided between the feed roller 75 and the surface 45 of the bypass tray 71.

The other end 50 of the holding arm 73 at the second position is positioned on the downstream side of the feed roller 75 in the feed direction 87. That is, the recording sheets S, which have been guided by the holding arm 73 and have passed between the feed roller 75 and the surface 45 of the bypass tray 71, are in a state of being held toward the surface 45 by the other end 50 of the holding arm 73. Thus, according to the configuration of this embodiment, the recording sheets S can be held toward the surface 45 on the downstream side of the feed roller 75 in the feed direction 87. This can reduce the possibility of occurrence of the overlapped feed of recording sheets S as compared with a case where the recording sheets S are held toward the surface 45 only by the feed roller 75.

In a case that pressure is applied on only one side of the feed roller 75 in the direction orthogonal to the feed direction 87 and extending along the surface 45 and that no pressure is applied on the other side, the recording sheet S is more likely to skew. According to this embodiment, since the recoding sheet S is held by the holding arms 73 on both sides of the feed roller 75, the possibility of occurrence of skew of the recording sheet S can be reduced.

According to this embodiment, in a state that no recording sheet S is supported by the bypass tray 71, the holding arm 73 is positioned at the first position by being biased by the torsion spring 52. In a state that the recording sheet S is supported by the bypass tray 71, the holding arm 73 is positioned at the second position by being pushed by the recording sheet S. That is, the sheet sensor 54 can detect whether or not the recording sheet S is supported by the bypass tray 71 based on the position of the holding arm 73. Thus, according to the configuration of this embodiment, since the holding arm 73 can function also as a detection target, which is detected by the sheet sensor 54 to detect as to whether or not the recording sheet S is supported, it is unnecessary to provide any exclusive detection target for detecting the recording sheet S in the feed apparatus 70.

According to this embodiment, the center of the swing shaft of the feed arm 76 is the same as the center of the swing shaft of the holding arm 73. Thus, it is unnecessary to provide the swing shafts of the feed arm 76 and the holding arm 73 individually. Thus, it is possible to simplify the structure of each of the feed arm 76 and the holding arm 73.

Modified Embodiments

In the above embodiment, the engagement portion 91 is constructed of the protrusions 91A, 91B. The engagement portion 91, however, may be constructed of those other than the protrusions 91A, 91B.

For example, the engagement portion 91 may be constructed of a key (not depicted) and a keyway having a substantially fan shape (not depicted), the key being provided at an end portion of the feed arm 76 on the side of the swing shaft 66, the keyway being positioned at the one end 49 of the holding arm 73 and being configured to mate with the key. The length of an arc of the keyway is designed to be longer than that of the key. In a case that the feed arm 76 is positioned on the side closer to the surface 45 from the position depicted in FIG. 8C, the key does not abut against the keyway. Thus, the swing of the feed arm 76 does not affect the holding arm 73. That is, even when the feed arm 76 swings in the direction of the arrow 68, the holding arm 73 never swings. On the other hand, in a case that the feed arm 76 is positioned on the side farther away from the surface 45 than the position depicted in FIG. 8C, the key abuts against the keyway to cause the feed arm 76 and the holding arm 73 to swing integrally. The engagement portion 91 constructed as described above functions similarly to the protrusions 91A, 91B.

In the above embodiment, the center of the swing shaft of the feed arm 76 is the same as the center of the swing shaft of the holding arm 73. However, the center of the swing shaft of the feed arm 76 may not the same as the center of the swing shaft of the holding arm 73. For example, the swing shaft of the holding arm 73 may be disposed on the upstream side of the swing shaft of the feed arm 76 in the feed direction 87.

In the above embodiment, two recess portions 46 are provided. However, the number of recess portions 46 is not limited to two. For example, only one recess portion 46 may be provided on the surface 45 of the bypass tray 71 at the right side of the feed roller 75.

In the above embodiment, two holding arms 73 are provided. However, the number of holding members 73 is not limited to two. For example, in a case that only one recess portion 46 is provided, only one holding arm 73 is provided corresponding to the one recess portion 46.

In the above embodiment, the feed apparatus 70 is an apparatus for feeding the recording sheet S supported by the bypass tray 71. The feed apparatus 70, however, may be an apparatus for feeding the recording sheet S supported by the feed tray 20.

In the above embodiment, the feed apparatus 70 is provided in the printer unit 11. However, an apparatus or unit for which the feed apparatus 70 is provided is not limited to the printer unit 11. For example, the feed apparatus 70 may be provided in the scanner unit 12. In this case, the feed apparatus 70 feeds a sheet having an image to be read by the scanner unit 12 into the scanner unit 12.

What is claimed is:

1. A feed apparatus configured to feed a sheet, comprising:

a support unit having a support surface configured to support the sheet;

a feed roller configured to feed the sheet supported by the support surface in a feed direction;

a first arm configured to rotatably support the feed roller at one end of the first arm, the first arm being swingable by using the other end of the first arm as a swing shaft;

a recess portion provided on the support surface; and a second arm having one end positioned on an upstream side of the other end of the second arm in the feed direction, having a distance between the one end of the second arm and the support surface which is greater than a distance between the other end of the second arm and the support surface, and configured to be swingable with a side of the one end of the second arm as a swing shaft, between a first position at which the other end of the second arm is in the recess portion and a second position at which the other end of the second arm is outside the recess portion;

a biasing member configured to bias the second arm toward the first position;

an operation lever provided in the first arm; and an engagement portion provided in the first arm and configured to abut against the second arm from a side of the support surface so as to be engaged therewith, wherein the engagement portion is configured to be separated from the second arm at the first position in a case that the feed roller abuts against the support surface;

the engagement portion is configured to be engaged with the second arm in a case that the first arm swings in a direction in which the feed roller is separated from the support surface; and the second arm is configured to swing from the first position to the second position in conjunction with swing of the first arm in a direction in which the feed roller is further away from the support surface.

2. The feed apparatus according to claim 1, wherein the engagement portion is a protrusion protruding from the first arm.

3. The feed apparatus according to claim 1, wherein a guide surface facing the support surface is positioned on an upstream side of the feed roller in the feed direction, the guide surface being a part which is included in the second arm at the first position and which does not enter the recess portion; and the other end of the second arm at the second position is positioned on a downstream side of the feed roller in the feed direction.

4. The feed apparatus according to claim 1, wherein the second arm includes a pair of arms, and the pair of arms are arranged to interpose the feed roller therebetween in a direction orthogonal to the feed direction and extending along the support surface.

5. The feed apparatus according to claim 1, further comprising a detecting unit configured to detect the second arm positioned at any one of the first position and the second position.

6. The feed apparatus according to claim 1, a swing center of the swing shaft of the first arm coincides with a swing center of the swing shaft of the second arm.

7. An image recording apparatus, comprising:

the feed apparatus as defined in claim 1; and a recording unit configured to record an image on a sheet fed by the feed roller.

* * * * *